US005482294A

United States Patent [19]

Sullivan et al.

[11] Patent Number: 5,482,294

[45] Date of Patent: Jan. 9, 1996

[54] ARCHERY BROADHEAD

[76] Inventors: Dennis E. Sullivan, 342F Camp Creek Rd.; Kevin M. Sullivan, Rte. 1, Box 3095, both of Lakemont, Ga. 30552

[21] Appl. No.: 442,472

[22] Filed: May 16, 1995

[51] Int. Cl.[6] ..... F42B 6/08

[52] U.S. Cl. ..... 273/422

[58] Field of Search ..... 273/422, 421, 273/420, 423

[56] References Cited

U.S. PATENT DOCUMENTS

| | | | |
|---|---|---|---|
| 2,926,016 | 2/1960 | Neal et al. | 273/423 |
| 4,210,330 | 7/1980 | Kosbab | 273/422 |
| 4,558,868 | 12/1985 | Musacchia | 273/422 |
| 4,643,435 | 2/1987 | Musacchia | 273/422 |
| 4,676,512 | 6/1987 | Simo | 273/422 |
| 4,986,550 | 1/1991 | Segovia | 273/422 |
| 5,160,148 | 11/1992 | Musacchia, Sr. | 273/422 |
| 5,427,385 | 6/1995 | Conrad et al. | 273/423 |

FOREIGN PATENT DOCUMENTS

| | | | |
|---|---|---|---|
| 525994 | 9/1940 | United Kingdom | 273/423 |
| 740209 | 11/1955 | United Kingdom | 273/420 |

OTHER PUBLICATIONS

Bear Archery 1977, Mar. 1977, p. 29, Metric Magnums.

*Primary Examiner*—Paul E. Shapiro
*Attorney, Agent, or Firm*—Jones & Askew

[57] ABSTRACT

An archery broadhead (10) for mourning to an arrow shaft includes a ferrule (16), a plurality of replaceable blade elements (18) supported by and extending from the ferrule, an engaging bar 22 and a tip (20) mounted to the ferrule opposite the arrow shaft. The ferrule defines a centrally located cavity (48) and a plurality of ferrule slots (60) extending longitudinally along the ferrule and communicating with the blade elements. The blade elements are supported by the ferrule by engaging the blade elements within the ferrule slots and disposing the securing flanges of each within the ferrule cavity. The engaging bar is inserted within the ferrule cavity and disposed in engagement with the blade elements substantially along the length of the securing flanges of the blade elements to discourage movement of the blade elements with respect to the ferrule slots. The tip is secured to the ferrule to discourage axial movement of the blade elements with respect to the slots. The broadhead blade elements are individually replaceable and, in some embodiments, interchangeable with other broadheads, without regard to the number of blade elements adapted to be mounted and supported by the broadhead ferrule.

28 Claims, 6 Drawing Sheets

ARCHERY BROADHEAD

TECHNICAL FIELD

The present invention relates to an archery broadhead and more particularly to an improved archery broadhead having replaceable blade elements.

BACKGROUND OF THE INVENTION

Many types of arrows are available for shooting with an archer's bow. An archer's choice of a particular arrow depends on the intended activity or use for the arrow. Arrows used for competitive target shooting generally differ from those used for hunting.

Arrows used for hunting typically comprise an arrow shaft and an arrowhead commonly referred to as a broadhead. A broadhead is mounted at a tip end of the arrow shaft opposite an arrow string engaging nock. Broadheads typically comprise a central ferrule which mounts a plurality of broadhead blade elements, each blade element presenting an inclined, razor sharp edge. These broadheads are designed for the purpose of striking and piercing a target, such as a game animal, and consequently inflicting a wound exhibiting profuse bleeding.

Broadhead blade elements typically resemble triangularly shaped razor blades. Two or more blade elements are typically mounted in longitudinally extending slots formed in the broadhead ferrule. These blades can be fixedly secured in the ferrule slots by several means. One means for fixedly securing blade elements in a broadhead is shown in U.S. Pat. No. 4,986,550, to Segovia. Segovia shows a broadhead comprising an arrowhead body or ferrule with longitudinally extending, radially oriented slots for accepting corresponding blade elements. Each blade element includes a central flange from which a sharpened blade extends. The blade flanges have acutely shaped projections at opposing ends. As shown in FIG. 1 of Segovia one projection fits captively within a cooperating portion of the slot and the other projection is engaged by a cooperating washer, which, when compressed against the ferrule, fixedly secures the blade unit in the slot.

Another blade element securing means is shown in U.S. Pat. No. 4,210,330, to Kosbab. Kosbab shows, in FIG. 2 thereof, a modular broadhead having a central ferrule with blade engaging slots radially offset from the central axis of the ferrule in planes parallel to planes tangent to the peripheral surface of the ferrule. Each blade includes opposed acute angle projections that cooperate, at one end of the blade, with an annular groove formed in a tip that threadedly engages the ferrule and, at the opposed end of the blade, with a ferrule collar. The engagement of the tip and ferrule collar with the acute angle projections secures the blade in captive engagement with the ferrule.

It is also known in the prior art to attach blades in a broadhead by means of slots passing transversely or radially through a ferrule. The blades are pre-assembled as a rigid subassembly and then engaged with the ferrule. Thus, the broadhead blades are apparently replaceable only as a complete unit. This type of broadhead and securing means is shown in FIG. 1 of U.S. Pat. No. 4,558,868, to Musacchia. Still another means for securing blade elements is shown in U.S. Pat. No. 5,160,148, also to Musacchia. In this patent, there is shown in its FIG. 1, a broadhead having an elongated ferrule which receives and supports removable blade elements. The blade elements include a main portion and a mounting flange offset from the main portion by a fixed angular amount. The angular offset of the flange apparently corresponds to the angular disposition between any two adjacent radially oriented, longitudinally extending slots formed in the ferrule. When assembled, the flange of a first blade element and the main body portion of a second and adjacent blade element occupy each of the slots. Thus, the slots must be approximately twice the width of the blade element material therein.

Broadheads are often easily damaged during use. The blade elements, and particularly the razor sharp edge defined along portions of the blade element, are susceptible to damage due to missed shots or when the archer makes his shot but the broadhead strikes a large bone of a game animal. Where a shot is missed the broadhead may strike rocks or other hard objects that break the blade element or cause sever nicks in the blades' sharpened edges. Where the arrow hits its mark, the broadhead may hit a large bone causing the blade elements to break, usually when the broadhead hits the large bone obliquely and glances off the bone thereby imparting most of the impact energy along one blade element.

One consequence of broken blade elements is that the arrow cannot be used until the broadhead is repaired. This is so because a broadhead with broken and/or missing blade elements will become statically and aerodynamically unbalanced. This unbalanced condition will prevent a launched arrow from traveling an intended and predictable trajectory. Also, if the arrow with a damaged broadhead does hit its mark, the broadhead may not inflict the type or quality of wound that is humanely desired by bow hunters.

Where blade elements fracture upon impact with a game animal, the blade fragments may become lodged within the animal at locations distant from the point of impact or entry of the broadhead. Thus, the blade fragments become a hazardous foreign body in the animal. Since most of these animals are often processed into food, as meat, and into skins, these foreign bodies may constitute a hazard to the processor or consumer of the animal meat or skin.

Blade elements that are mounted into slots extending along a broadhead ferrule and secured fixedly only by engagement of acute blade projections at the opposed ends of the ferrule are particularly susceptible to separation of broken portions of the blade from the broadhead ferrule. When these types of blades fracture, the loss of only a portion of the blade element, initially, usually leads to the loss of the entire blade element because the blade element is not actually mechanically, captively engaged along its entire length by the ferrule and the mechanical engagement of the acute projections is breached when a portion of the blade element is lost.

Broadheads such as those shown in the Musacchia patents avoid this problem to a great degree since the blade elements are mechanically engaged with the ferrule along the length of the blade element adjacent the ferrule. This configuration causes problems in the practical use of the broadheads however. In the former Musacchia patent, the blade elements are mechanically interconnected to form a rigid subassembly which is only replaceable as a complete unit. Thus, even though only one blade element is broken the entire unit must be replaced. This is expensive and time consuming. Also, the ferrule for these broadheads is fabricated specifically for particular configurations of blade subassemblies. For example, a three blade subassembly will not adapt to a ferrule provided with four equally spaced ferrule slots; nor will a four blade subassembly fit a three slotted ferrule.

The latter Musacchia patent attempts to overcome the problems associated with requiring blade subassemblies by providing a broadhead with individual, replaceable blades. However, the broadhead of the latter Musacchia patent requires that a portion of the flange of one of the blade elements be positioned alongside the blade body of an adjacent blade element within the same slot. This configuration requires that the width of the slot be more than twice as thick as the blade width. A double width slot may result in a weaker ferrule because twice as much ferrule material is removed. Also, the number of blades capable of being supported by a broadhead of the latter Musacchia type, is limited because of the width of the slot necessary to mount the blade elements.

Therefore it may be seen that there is a need in the art for an archery broadhead having replaceable blade elements that are mechanically and captively engaged by the broadhead ferrule along substantially the entire length of a blade mounting flange and which maximizes the number of blade elements adapted to be supported by the broadhead ferrule.

SUMMARY OF THE INVENTION

The present invention overcomes the deficiencies in the prior art by providing an archery broadhead having replaceable blade elements that are mechanically and captively engaged by the broadhead ferrule along substantially the entire length of a blade mounting flange and which maximizes the number of blade elements adapted to be supported by the broadhead ferrule.

Generally described, the present invention is an archer's broadhead having a longitudinally extending ferrule and a plurality of blade elements mounted by and extending from the ferrule. The ferrule defines a longitudinally extending central cavity and a plurality of ferrule slots extending from and communicating with the central cavity. Each blade element defines a generally triangularly shaped blade body, having a sharpened blade edge, which extends from the ferrule slot. A securing flange extends from the blade body and, in one embodiment, is angularly displaced from the blade edge. The securing flange extends through the ferrule slot and into the ferrule cavity. An engaging bar is disposed in the ferrule cavity and engages portions of the securing flange thereby discouraging movement of the blade elements relative to the ferrule slot. A tip threadedly engages the ferrule so as to secure the blade elements and the engaging bar to the ferrule.

In another embodiment, the broadhead of the present invention includes replaceable and interchangeable blades that are adaptable to broadheads having one or more ferrule slots without regard to the number of ferrule slots.

Thus, it is an object of the present invention to provide an improved archer's broadhead.

It is an another object of the present invention to provide a broadhead with replaceable blades.

It is a further object of the present invention to provide a broadhead having blades that are replaceable and interchangeable without regard to the number of ferrule slots defined in the broadhead.

It is another object of the present invention to provide a broadhead in which the blade elements are mechanically secured to the ferrule along substantially the entire length of an elongate portion of the blade element.

Other objects, advantages and features of the present invention will be more readily understood from the following detailed description of specific embodiments thereof when read in conjunction with the accompanying drawings.

DETAILED DESCRIPTION OF THE DRAWINGS

Turning next to the Figures in which like numerals indicate like parts, the preferred embodiment of the present invention will now be described.

Figure 1:
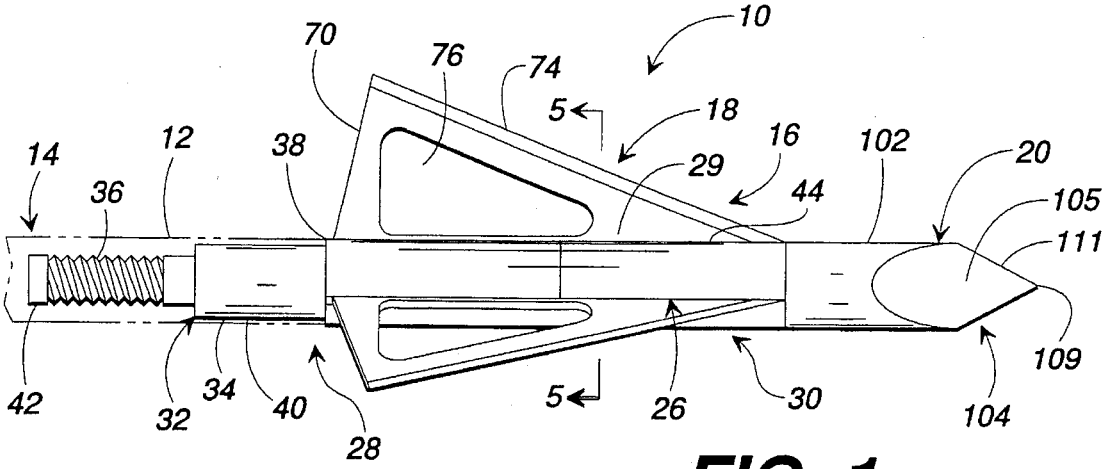
FIG. 1 is a side elevational view of a broadhead assembly of the present invention.
Figure 12:
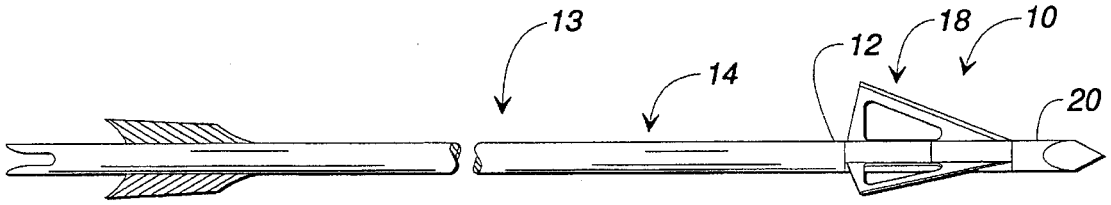
FIG. 12 is a side elevational view of an arrow engaged with the broadhead of the present invention.

Looking first at FIGS. 1–3 there is shown a first embodiment of a broadhead assembly 10 shown adapted in engagement with an engaging end 12 of an arrow shaft 14 shown in phantom lines. A complete arrow 13 supporting a broadhead assembly 10 is shown in FIG. 12.

The broadhead assembly 10 includes a ferrule 16, a plurality of blade elements 18, a detachable tip 20 and an elongate engaging bar 22.

The ferrule 16 includes a centrally located blade mounting portion 26, a shaft engaging end 28 at one end of the blade mounting portion 26 and an opposed tip end 30. The ferrule 16 is typically fabricated of an aluminum alloy, however other materials such as alternative metals and plastics are within the contemplation of the present invention.

The shaft engaging end 28 of the ferrule 16, shown in FIGS. 1–3, includes an integral shaft mounting extension 32. Those skilled in the art of archery broadheads will appreciate that there are means other than the mounting extension 32, shown in the figures, for engaging the broadhead assembly 10 with an arrow shaft 14. For example, some broadheads may be provided with a cylindrical extension integral with the ferrule 16 which is adapted for mounting a glue-mount broadhead to a cooperating arrow shaft adapted for glue mounted broadheads. Other broadheads may be provided with a female threaded cylindrical extension integral with the ferrule 16 which is adapted to engage a mating male threaded stud extending from the arrow shaft. Thus the integral stud 32 shown in the figures is provided for illustrative purposes and is not meant to limit the present invention herein.

The integral mounting extension 32 includes an alignment shoulder 34 and a threaded stud 36 extending from the alignment shoulder opposite the blade mounting portion 26.

The shaft engaging end 28 of the ferrule 16 also defines an abutting shoulder 38 against which the transverse face of the engaging end 12 of the arrow shaft 14 abuts when the broadhead assembly 10 is secured to the arrow shaft 14. The diameter of the ferrule 16 adjacent the abutting shoulder 38 may be substantially equal to the diameter of the arrow shaft 14 adjacent the arrow engaging end 12. The equivalent diameters prevent abrupt changes in diameter that may tend to alter the aerodynamic balance of the arrows during flight and generally allows greater penetration into a target.

The alignment shoulder 34 is adapted to be journaled within a receiving bore 40 defined within the arrow shaft 14 adjacent the engaging end 12. The clearance between the outer peripheral surface of the shoulder 34 and the receiving bore 40 is defined to provide precise alignment of the longitudinal axes of the broadhead assembly 10 and the arrow shaft 14 in a well known manner. The precise alignment of the broadhead 10 with the arrow shaft 14 helps to maintain the aerodynamic balance of a complete arrow assembly. The threaded stud 36 of the integral mounting extension 32 is adapted to be received in a cooperating threaded aperture 42 formed within the arrow shaft 14, along the longitudinal axis thereof, adjacent the receiving bore 38.

The blade mounting portion 26 of the ferrule 16 comprises the major length of the ferrule 16 and is the mounting site of the blade elements 18. The blade mounting portion 26 defines a generally circular cross section and includes a forward section 44, which defines a first constant ferrule diameter, and a rearward flared section 46 defining a varying diameter, the diameter of the forward section 44 being smaller than the flared section 46 diameter. The reduced diameter of the forward section 44 results in lowered weight and increased penetration of the broadhead assembly 10 by reducing the drag surface area. The flared section 46 provides a transition between the forward section 44 and the diameter of the arrow shaft 14.

The forward section 44 of the ferrule 16 defines a longitudinally extending central cavity 48 that is aligned along the central axis of the ferrule 16. As shown in FIGS. 2, 3 and 5, the cavity 48 includes a closed end 50 adjacent the shaft engaging end 28 of the ferrule 16 and an open end 52, coincident with the tip end 30. A cavity sidewall 54 extends between the open end 52 and the closed end 50.

In one embodiment of the present invention, shown in FIG. **3*b*, the central cavity 48 is a hollow central cavity which may be formed by drilling along the central axis of the ferrule 16 with a drill having a prescribed diameter and to a prescribed depth into the forward section 44. Thus, a solid cylinder of material is removed from the ferrule 16 to form the central cavity 48. The cavity 48** remaining after drilling may then be reamed to a precise diameter.

In another embodiment of the present invention shown in FIG. **3*a*, the cavity 48 is an annular cavity. The annular cavity 48 is formed using a cutting tool for cutting a longitudinally extending annular cavity, often referred to as a plug cutter, to remove a solid annular portion of material from the ferrule 16. After this machining operation, a cylindrical, centrally located longitudinally extending element remains within the ferrule 16 and extends from the closed end 50 of the cavity 48. The element thus comprises an integral engaging bar 22. The integral engaging bar 22 acts as, and performs the securing function of, the engaging bar 22**, as will be explained in more detail below.

The forward section 44 of the blade mounting portion 26 also defines a plurality of longitudinally extending slots 60, one slot 60 for each blade element 18 intended to be supported by the ferrule 16. Each slot 60 defines a width W only slightly greater than the width of the metal stock used to fabricate the blade elements 18.

Each ferrule slot 60 communicates between the outer peripheral surface of the ferrule 16 and the ferrule cavity 48. The slots 60 may be formed by conventional machining techniques such as by sawing with a circular slitting saw. The slots 60 may be formed to extend radially from the cavity 48 as shown in the embodiments of the broadhead in FIGS. 2–3 and 5. Alternatively, the slots 60 may be disposed in the ferrule 16 in planes parallel to planes tangent to the peripheral surface of the ferrule 16, such as the slots 60 formed in the ferrules 16 of the broadhead 10 shown in FIGS. 6–10.

Each slot 60, shown in FIGS. 2 or 3, defines an arcuate portion 62 which is formed by the circular slitting saw as it enters into, or emerges from, the ferrule 16. As will be explained in more detail below, portions of the blade elements 18 are configured to accommodate the arcuate portion 62 of the slot 60.

The transition of the slots 60 with the central cavity 48 creates a support edge 64. The support edge 64 cooperates with portions of the blade elements 18 to further support the blade elements 18 mounted in the ferrule 16.

The complement of blade elements 18 included in a particular broadhead assembly 10 is determined, in part, by the application of the broadhead and the individual preference of the archer. Broadheads with fewer blade elements are generally lighter in weight than those with more blade elements. However, broadheads having more blade elements have greater cutting power owing to the increased number of cutting edges present. Therefore, there is a compromise between broadhead weight, which affects the speed and trajectory of the arrow, and the cutting power of the arrow.

The number of blade elements 18, supported by a broadhead assembly 10, is also limited by the slot width and the blade element 18 design. When the slots 60 are cut, or otherwise formed in the ferrule 16, the forward section 44 of the blade mounting portion 26 becomes segmented into a plurality of upstanding ferrule fingers 66. As the number of slots 60 formed in the ferrule 16 increases, the width of the ferrule fingers 66 decreases, thereby weakening, to some degree, the ferrule fingers 66 relative to a ferrule 16 having fewer slots 60. Weakened ferrule fingers 66 may not withstand the forces transmitted to and through the broadhead assembly 10 under some shooting conditions. Thus, the thicker the ferrule fingers 66, the higher the strength of the broadhead 10.

Figure 4:
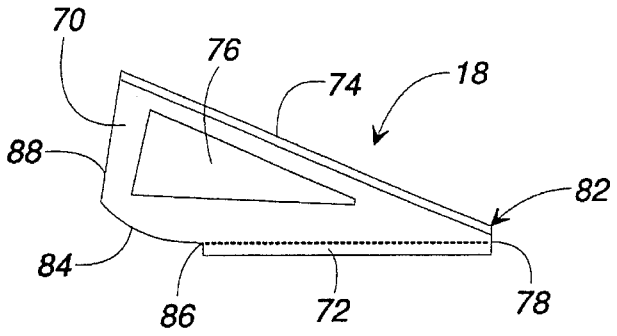
FIG. 4 is a side elevation of a typical blade element of the broadhead of the claimed invention.
Figure 9:
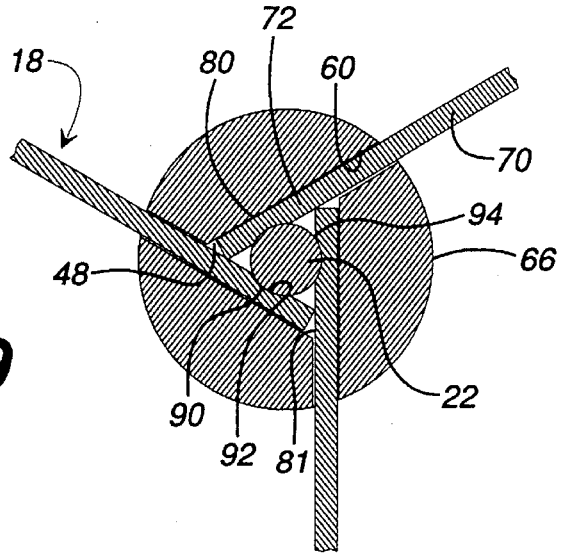
FIG. 9 is a transverse cross-sectional view of a third embodiment of the present invention showing a first alternative blade and ferrule configuration having three blade elements.
Figure 10:
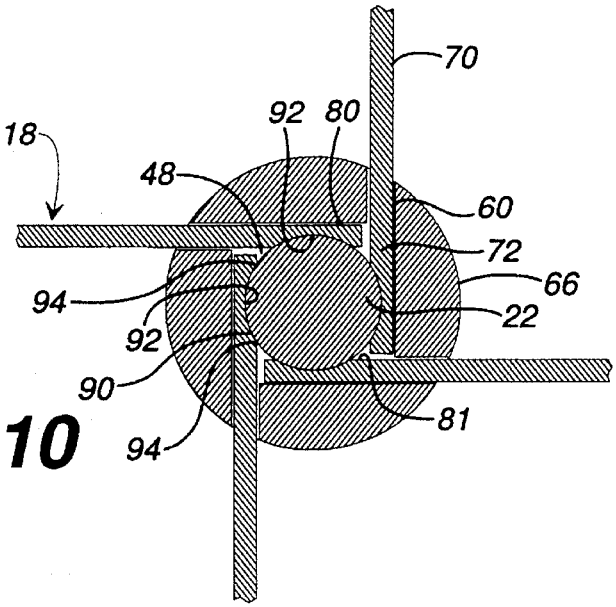
FIG. 10 is a transverse cross-sectional view of the third embodiment of the present invention showing a second alternative blade and ferrule configuration having four blade elements.
Figure 13:
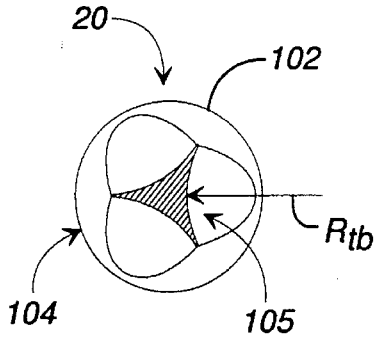
FIG. 13 is a cross-sectional end view of the tip taken along line 13—13 of the broadhead shown in FIG. 2*a*.
Figure 11A:
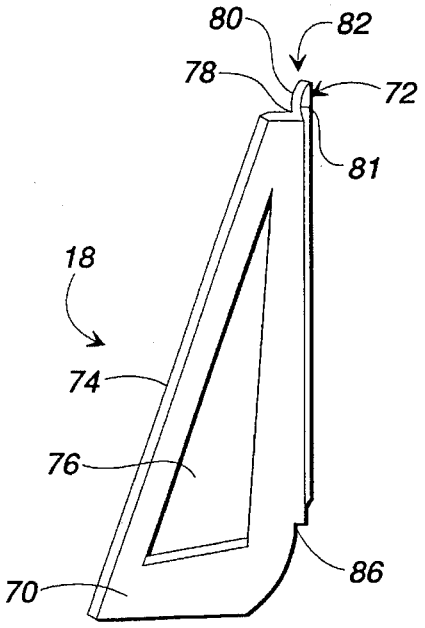
FIG. 11*a* is a pictorial view of the blade element of the present invention having an angularly displaced and curved securing flange.
Figure 11B:
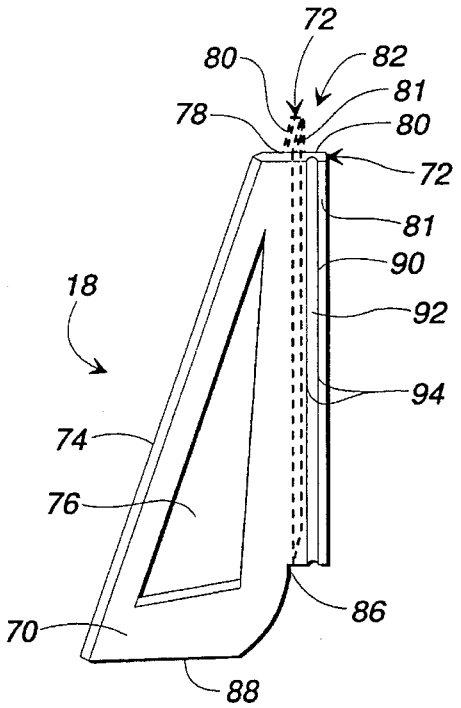
FIG. 11*b* is a pictorial view of the blade element of the present invention having coplanar securing flange and showing an angularly displaced, planar securing flange in phantom lines.

In FIG. 4 there is shown a side elevational view of a typical blade element 18. Pictorial views of alternative configurations of the blade element 18 are shown in FIGS. 11*a* and 11*b*. Transverse cross-sectional views of alternative blade element 18 configurations are shown in FIGS. 5–10. Each blade element 18 comprises a generally triangularly shaped planar blade body 70 and a securing flange 72 extending from the blade body 70. The blade body 70 includes a sharpened blade edge 74 angularly displaced from the securing flange 72.

The blade body 70 defines a generally centrally located cut-out or window 76. The blade window 76 reduces the mass of the blade element 18. The window 76 also reduces the tendency of the arrow to follow an unintended trajectory due to a mis-aligned blade element 18. Where the blade element 18 is mis-aligned in the ferrule 16, such that the plane of the blade body 70 is inclined slightly from a plane including the central axis of the ferrule 16, air passing over the planar surface of the blade body 70 will be inclined to the planar surface of the blade body 70 causing a differential air pressure distribution on opposing planar surfaces of the blade body 70. The differential pressure may change the trajectory of the arrow or cause unintended arrow spin. The effect of the misalignment is reduced by the windows 76 which reduce the surface area over which the differential pressure forces act. The windows 76 also promote more profuse bleeding in wounded animals, thereby hastening death.

The securing flange 72 of the blade element 18 is disposed within the ferrule cavity 48 when the blade element 18 is in supported engagement with the ferrule 16. As shown in FIGS. 5–8 and 11*a* and 11*b*, the securing flange 72 may be angularly offset from the blade body 70 a prescribed angular displacement. Alternatively, the securing flange 72 may extend straight from, in coplanar relation to, the blade body 70, as shown in FIGS. 9–10 and 11*b*. FIG. 11*b* shows the two alternative configurations of the securing flange 72.

The securing flanges 72 of the blade elements 18 extend continuously along a substantial length of the blade body 70. The securing flange 72 defines a first flange side 80 that engages the cavity sidewall 54 when the broadhead assembly 10 is assembled. The securing flange 72 further defines an opposed second flange side 81 which engages the outer peripheral surface of the engaging bar 22 when the broadhead assembly 10 is assembled. The securing flange 72 is coterminous with the sharpened edge 74 at a leading end 82 of the blade element 18. The securing flange 72 is truncated adjacent an arcuate side edge 84 which seats into the arcuate portion 62 of the slots 60 when the broadhead assembly 10 is assembled. The arcuate side edge 84 is undercut relative to the securing flange 72, forming a notch 86 which, when the blade element 18 is seated into engagement with the ferrule 16, engages the blade support edge 64 of the ferrule 16.

A lagging edge 88 joins the arcuate side edge 84 and the sharpened edge 74. The lagging edge 88 may be perpendicular to the securing flange 72 or may be inclined from the perpendicular as shown in FIG. 4. The lagging edge 88 is usually blunt, however, in some applications, may be sharpened.

Figure 5A:
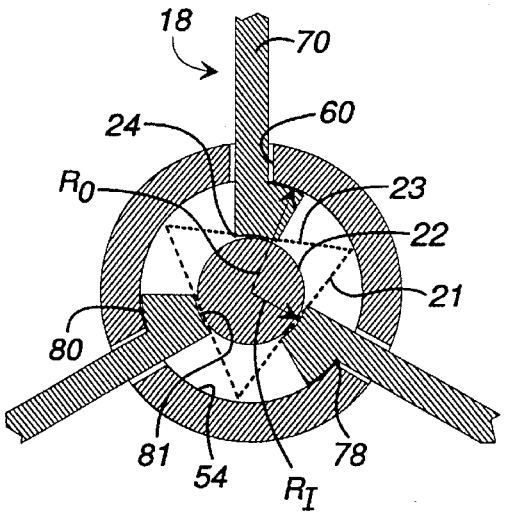
FIG. 5*a* is a transverse cross-sectional view of the three blade element broadhead of FIG. 1, taken along line 5—5.
Figure 5B:
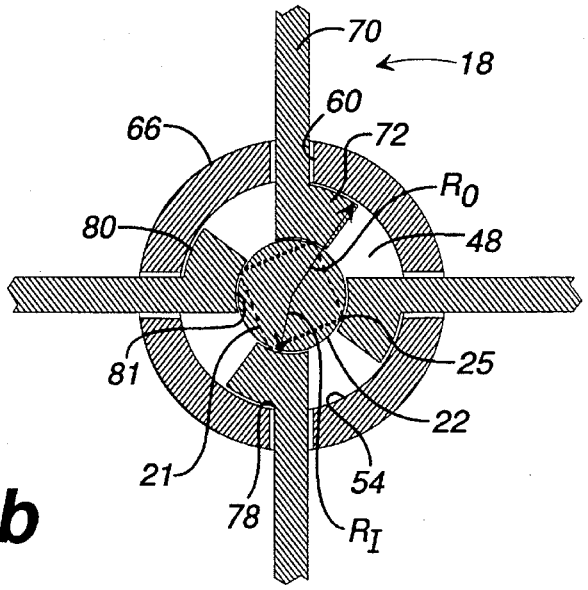
FIG. 5*b* is a transverse cross-sectional view of a broadhead similar to the broadhead assembly shown in FIG. 1, taken along line 5—5 except having four blade elements.

When viewed in end elevation, the blade securing flanges 72, shown in FIGS. 5*a* and 5*b*, are curved outwardly of the bend line 78 such that they define an inner radius of curvature $R_I$ of the second flange side 81. The securing flange 72 further defines an outer radius of curvature $R_O$ of the first flange side 80. The securing flange radii, $R_I$ and $R_O$, are sized to be substantially equal to the radii of curvature of the engaging bar 22 and the cavity side wall 54, respectively.

Figure 6:
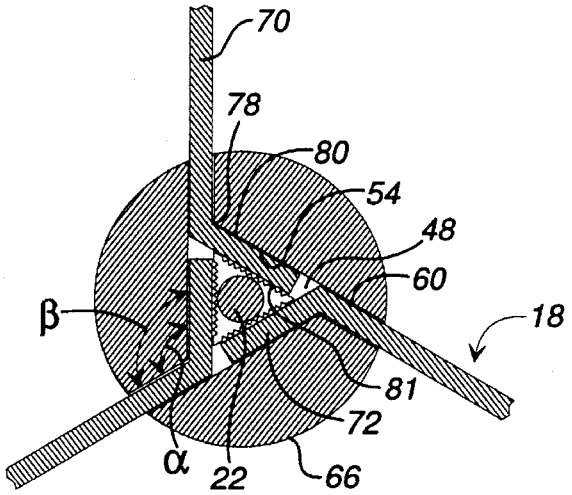
FIG. 6 is a transverse cross-sectional view of a second embodiment of the broadhead assembly of the present invention showing including a first alternative blade and ferrule configuration having three blade elements.
Figure 7:
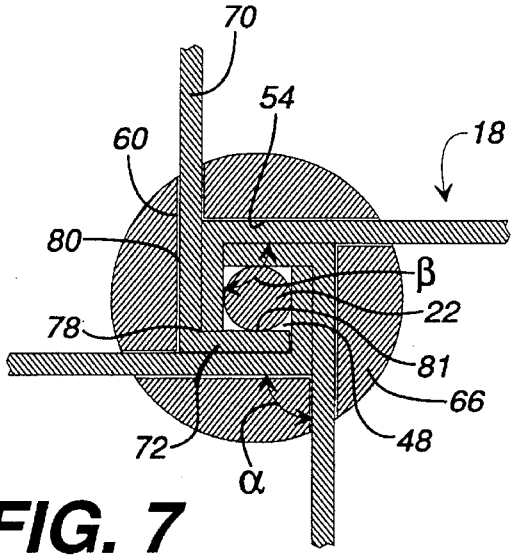
FIG. 7 is a transverse cross-sectional view of the second embodiment of the present invention showing a second alternative blade and ferrule configuration having four blade elements.
Figure 8:
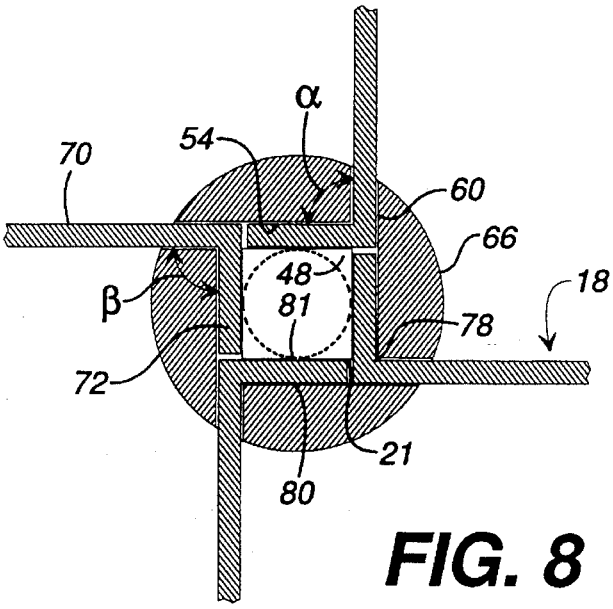
FIG. 8 is a transverse cross-sectional view of the second embodiment of the present invention showing a third alternative blade and ferrule configuration having four blade elements.

Other angularly offset securing flanges 72 are planar when viewed in end elevation, such as those shown in FIGS. 6–8. The securing flanges 72 are offset a prescribed angular displacement $\beta$ which corresponds to an included angle $\alpha$ defined by adjacent slots 60 of the ferrule 16. The included angle $\alpha$ is numerically equal in degrees to 360/n where n equals the number of slots 60 formed in the ferrule 16. Thus, the included angle $\alpha$ of the ferrule shown in FIG. 6 is 120°, whereas the included angle $\alpha$ of the ferrule 16 of FIG. 8 is 90°. Accordingly, the angular offsets $\beta$ of the securing flanges 72 of the blade elements 18 shown in FIGS. 6 and 8, are 120° and 90°, respectively.

Blade elements 18 comprising securing flanges 72 extending in coplanar relation to the blade body 70, such as those shown in FIGS. 9 and 10, define an engaging groove 90 formed in the first flange side 80. The groove 90 includes a groove surface 92 bounded by groove edges 94. The engaging groove 90 is formed by well known processes including material removal processes, such as grinding, or by material deformation processes such as pressing or rolling. The radius of curvature of the engaging groove surface 92 is preferably equal to or slightly less than the radius of curvature of the engaging bar 22. This relationship between the radii of curvature of the engaging groove 92 and the engaging bar 22 will provide either full surface contact between the groove surface 92 and the surface of the engaging bar 22 or two line contact between the groove edges 94 and the engaging bar 22. The engaging bar 22 preferably cooperates with all of the engaging grooves 90 of the blade elements 18 supported by the broadhead assembly 10 to retain the blade elements 18 in captive engagement with the ferrule 16.

It is informative to note that blade elements 18 having curved, angularly displaced securing flange 72, shown in FIGS. 5*a* and 5*b*, and those having securing flanges 72 disposed in coplanar relation to the blade body 70, shown in FIGS. 9 and 10, are not only replaceable, but are interchangeable with other broadhead ferrules 16, adapted for use with those types of blade elements 18, without regard to the number of slots 60 defined in the ferrule 16. The same is not true for the blade element and ferrule combinations shown in FIGS. 6–8. Thus, blade elements 18 supported by the three blade broadhead ferrules 16 shown in FIGS. 5*a* and 9 are interchangeable with the four blade broadhead ferrules 16 shown in FIG. 5*b* and 10, respectively. This is true, provided that the respective sidewall 54 and securing flange 72 radii and the engaging bar 22 diameters are the same for each of the ferrules 16 shown in FIG. 5*a* and 5*b*.

The engaging bar 22 is sized and configured to discourage movement of the blade element 18 with respect to the ferrule 16. Where the blade securing flange 72 is angularly offset, as shown in FIGS. 5–8, the engaging bar 22 is sized in diameter so that, as the engaging bar 22 is urged into engagement with the second flange side 81, the first flange side 80 is urged into engagement with the cavity side wall 54. The clearance between the cavity side wall 54 and the first flange side 80 and the engaging bar 22 peripheral surface and the second flange side 81 is eliminated. However, the engagement bar 22 need not, necessarily, be in compressive engagement with the securing flange 72 and the cavity side wall 54. This avoids the need of hand tools or presses to assemble the broadhead assembly 10 of the present invention.

Where the securing flange 72 extends from the blade body 70 in coplanar relation as shown in FIGS. 9 and 10, the engaging bar 22 is inserted into the ferrule cavity 48 so that the peripheral surface of the engaging bar 22 contacts the groove surface 92 of the groove 90 or, as explained above, engages the groove edges 94. Furthermore, the engaging bar 22 is sized in diameter so that, as the engaging bar 22 is urged into engagement with the groove surface 92 or edges 94, the first flange side 80 is urged into engagement with the cavity side wall 54. The clearance between the cavity side wall 54 and the first flange side 80 and the engaging bar 22 peripheral surface and the groove surface 92 or groove edges 94, is thus eliminated.

All of the blade element configurations shown in the figures may utilize engaging bars 22 having circular cross-sections. Faceted engaging bars 21 may also be used selectively with the broadhead assembly 10. For example, broadhead assemblies 10 supporting angularly offset securing flanges 72 may utilize a faceted engaging bar 21. As shown in FIG. 8, the faceted engaging bar 21 has a square cross-section. Note that a circular engaging bar 22 is shown in phantom lines superimposed on the square cross-section faceted engaging bar 21. In FIG. 6, the engaging bar 22 is circular in cross-section and a faceted, triangular cross-section engaging bar 21 is shown in phantom lines.

In FIG. 5*a*, a circular cross-section engaging bar 22 is shown supporting the blade elements 18. A triangularly configured faceted engaging bar 21, shown in phantom lines may also be used to support the blade elements. A longitudinally extending facet face 23, of the faceted engaging bar 21, establishes two-line contact along edges 24 extending along the second flange side 81 of the securing flange 72. An alternatively configured, faceted engaging bar 21 is shown in FIG. 5*b*. The broadhead assembly 10 shown in FIG. 5*b* supports four blade elements 18. A square cross-section faceted engaging bar 21 is disposed in the cavity 48 such that comers 25 of the faceted engaging bar 21 engage, in single line contact, the second flange side 81.

Figure 2A:
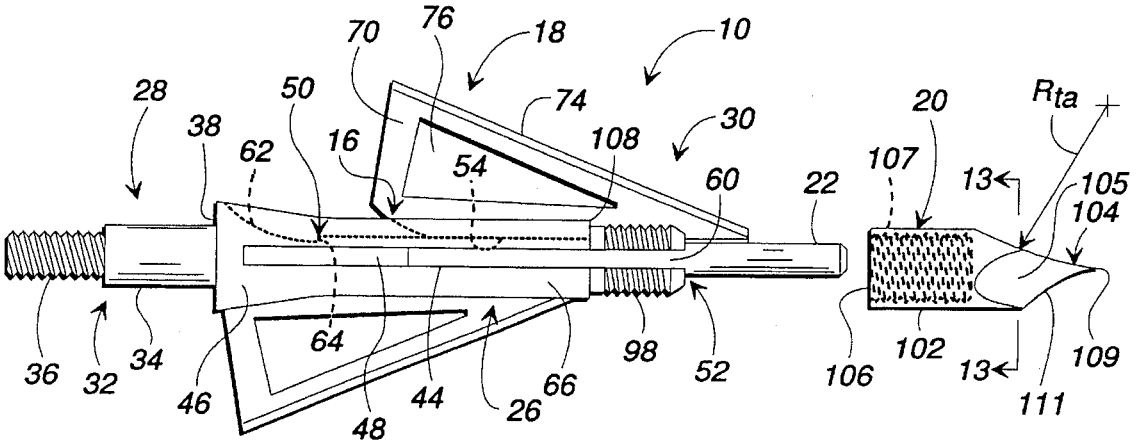
FIG. 2*a* is an exploded side elevational view of the broadhead assembly of FIG. 1 shown with a separate engaging bar.

Two alternative configurations of the tip end 30 of the ferrule 16 are shown in the figures. As is shown in FIGS. 2*a*, 3*a* and 3*c*, the tip end 30 may be provided with threads 98 which are adapted to threadedly receive a tip 20 having an internally threaded receiving bore. Alternatively, the tip end 30 may define a bevel 100 along the peripheral edge of the ferrule adjacent the open end 52 of the ferrule cavity 48, as shown in FIGS. 2*b* and 3*b*.

The tip 20, shown in FIGS. 1, 2*a* and 2*b* and 13, is a trocar tip, comprising a cylindrical barrel 102 and a tri-faceted point 104, comprising a plurality of facet faces 105 extending from the cylindrical barrel 102 to a tip apex 109. Other tip point configurations, such as four faceted and conical points are well known in the an. The facet faces 105 may be planar in configuration or may define a curved surface configuration defining a radius of curvature $R_{1a}$, shown in FIG. 2*a*, having an axis of rotation that is perpendicular to the longitudinal axis of the ferrule 16. Alternatively, the facet faces 105 may define a radius of curvature $R_{1b}$, shown in FIG. 13, having an axis of rotation parallel to the longitudinal axis of the of the ferrule 16. The facet faces 105 may also define a compound curved surface having radii of curvature $R_{1a}$ and $R_{1b}$. Providing the facet faces 105 with one or more radii of curvature results, advantageously, in a more acute cutting edge 111 formed by the adjacent facet faces 105. The cutting edges 111 are also longer when the facet faces 105 define a radius of curvature $R_{1a}$ than if the facet faces 105 are planar in configuration.

Figure 2B:
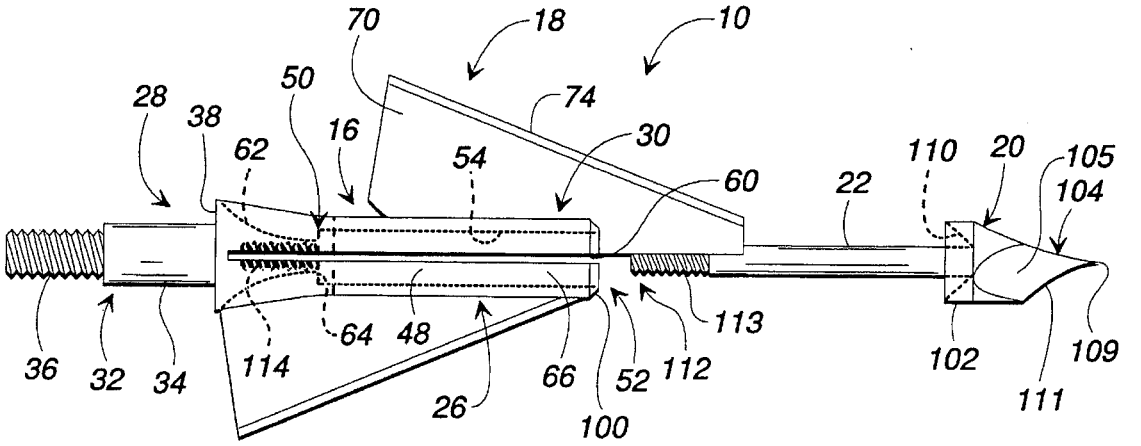
FIG. 2*b* is an exploded side elevational view of the broadhead assembly of FIG. 1 shown with an integral engaging bar.
Figure 3A:
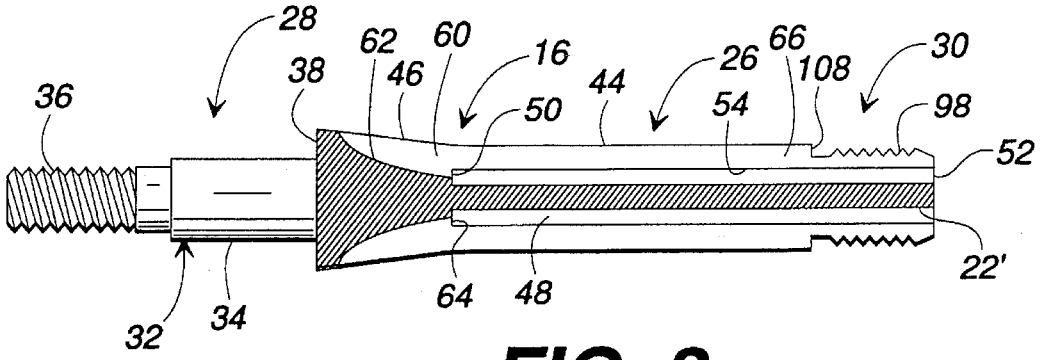
FIG. 3*a* is a cross-sectional side view of a broadhead ferrule having an integral engaging bar and external tip attaching threads.
Figure 3B:
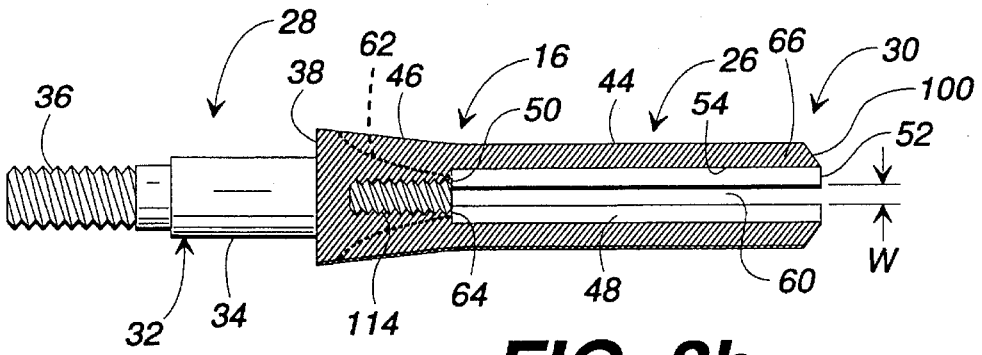
FIG. 3*b* is a cross-sectional side view of a broadhead ferrule having internal tip attaching threads.
Figure 3C:
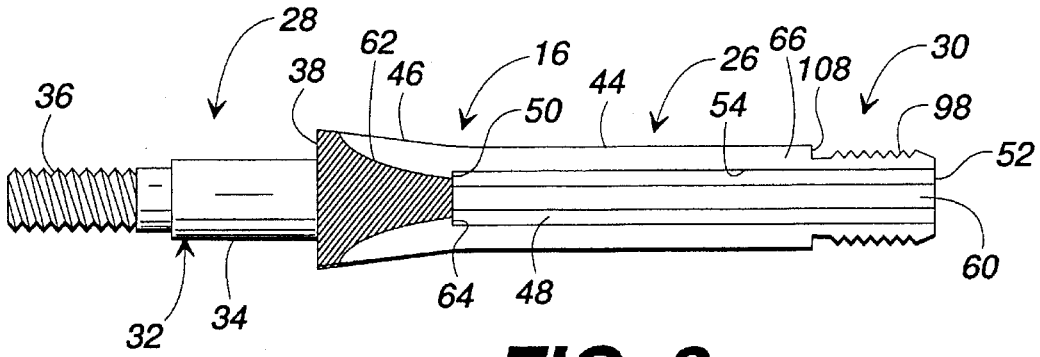
FIG. 3*c* is a cross-sectional side view of a broadhead ferrule having external tip attaching threads.

The tips 20 may include a fixed engaging bar 22, as shown in FIG. 2*b* or the engaging bar 22 may be separate from the tip 20, as shown in FIG. 2*a*. The tip 20 secures the blade elements 18 within the ferrule 16, supports the ferrule fingers 66 and provides a sharp tip for initiating piercing of the object at which the arrow is shot.

Tips 20 adapted for use with ferrules 16 having a threaded tip end 30 are provided with a relative long cylindrical barrel 102 which defines an internally threaded receiving bore 106 having threads 107. The threads 107 are adapted to threadedly engage the threads 98 of the ferrule tip end 30.

Preferably, the outside diameter of the cylindrical barrel 102 of the tip 20 is substantially equal to the outside diameter of the forward section 44 between the threads 98 and the rearward section 46. This provides a smooth transition between the tip 20 and the ferrule 16 to insure desirable aerodynamics of the broadhead assembly 10 at the transition point. Accordingly, the outside diameter of the threads 98 is reduced relative to the forward section 44 adjacent the threads 98. The threaded receiving bore 106 and threads 107 are appropriately sized to engage the threads 98. Alternatively, the diameter of the barrel 102 may be greater or less than the diameter of the forward section 44 of the ferrule 16, depending on the particular application or broadhead design.

The reduced threaded diameter of the tip end 30 forms a tip abutting shoulder 108. The transverse face of the cylindrical barrel 102 adjacent the receiving bore 106 cooperatively engages the tip abutting shoulder 108 when the tip 20 is screwed onto the ferrule 16.

Tips 20 adapted for use with ferrules 16 having a beveled tip end 30, shown in FIG. 2*b*, include a relatively short cylindrical barrel 102. The barrel 102 defines an internal annular bevel 110 adjacent the peripheral edge of the barrel 102 opposite the tip point 104. The internal annular bevel 110 cooperates with the bevel 100 formed at the tip end 30 of the ferrule 16 shown in FIGS. 2*a* and 3*b*.

Tips 20 for use with ferrules having beveled tip ends 30 are provided with a fixed engaging bar 22 secured in engagement with the tip 20. The tip 20 and the engaging bar 22 may be machined from a single piece of bar stock or, the tip 20 and a separate engaging bar 22 may be joined together by conventional means such as press fitting one end of the separate engaging bar 22 into a receiving aperture formed in the tip 20, which is well known. A free end 112 of the engaging bar 22 is provided with threads 113. A cooperating threaded aperture 114 is formed adjacent the closed end 50 of the cavity 48 as shown in FIGS. 2*b* and 3*b*.

Broadhead assemblies 10 comprising blade elements 18 having angularly offset securing flanges 72, both curved and planar, are assembled by inserting, longitudinally, the lagging edge 88 of the blade element 18 into the ferrule slots 60 from the open end 52 of the ferrule 16. The blade element 18 is moved longitudinally within the cavity 48 until the notch 86 engages the blade support step 64 adjacent the closed end 50 of the cavity 48. If the ferrule 16 includes an integral engaging bar 22', then no separate engaging bar 22 need be inserted. Where the ferrule 16 does not include an integral engaging bar 22' then a separate engaging bar 22 is inserted into the cavity 48 so that the engaging bar 22 engages the second flange side 81 of the blade elements 18.

Broadhead assemblies 10, having blade elements 18 with coplanar securing flanges 72, and a ferrule 16 of the type shown in FIG. 2 and 3*b*, that is, without an integral engaging bar 22', are assembled by first inserting the securing flanges 72 of the blade elements 18 laterally through the slots 60. The securing flanges 72 are disposed within the cavity 48 so that the engaging grooves 90 are facing the center of the cavity 48. An engaging bar 22 is then inserted longitudinally within the cavity 48 between the securing flanges 72 to cooperatively engage the engaging grooves 90 of the blade elements 18 within the ferrule 16. The dimensions of the cavity 48, the blade elements 18, including the flange thickness and the depth of the engaging groove 90, and the dimensions of the engaging bar 22 are sized and configured so that substantially no clearance or slack remains between the cavity sidewall 54, the blade elements 18 and the engaging bar 22 after broadhead assembly 10 is assembled. Thus, the engaging bar 22 interferes with the engaging grooves 90 of the blade elements 18 to discourage movement of the blade elements 18 relative to the slots 60.

Where the broadhead assembly 10 includes blade elements 18 having coplanar securing flanges 72 and a ferrule 16 having an integral engaging bar 22', as shown in FIG. 3*a*, the blade elements 18 are inserted longitudinally into the ferrule slots 60 from the open end 52 of the ferrule 16 and moved longitudinally relative to integral engaging bar 22' until the notch 86 engages the blade support edge 64 adjacent the closed end 50 of the cavity 48.

Prior to engaging the tip 20, shown in FIG. 2*a*, with the ferrule 16, a separate receiving bar 22 is disposed within the cavity 48. It is to be understood that the tip 20 having an internally threaded receiving bore 106 may be provided with a fixed receiving bar 22. Securing the tip 20 to the threaded ferrule 16 binds the ferrule fingers 66 to fixedly secure the blade elements into the broadhead assembly 10.

In FIG. 2*b*, the tip 20 is engaged with the ferrule 16 by inserting the free end 112 of the engaging bar 22 into the cavity 48 and threadedly engaging the threads 113 with the threaded aperture 114. The tip 20 is rotated relative to the ferrule 16 to advance the engagement of the threads 113 and the aperture 114, and, in so doing, the internal annular bevel 110 of the tip 20 engages the bevel 100 of the tip end 30 of the ferrule 16. The engagement of the internal annular bevel 110 with the bevel 100 secures the blade elements 18 in the broadhead assembly 10 and shores the ferrule fingers 66 to prevent them from spreading.

In view of the foregoing description of the preferred embodiment in its intended environment, other embodiments of the present invention will suggest themselves to those skilled in the art. Therefore, the scope of the present invention is to be limited only by the claims below and equivalents thereof.

We claim:

1. An archery broadhead assembly comprising:

a ferrule, said ferrule including an elongate body having an outer peripheral surface, a shaft engaging end and an opposed tip end, said ferrule body defining an axially extending centrally located ferrule cavity and having an inner cavity side wall adjacent said ferrule cavity, said ferrule body further defining at least one ferrule slot extending longitudinally along said ferrule body and communicating between said outer peripheral surface and said ferrule cavity;

at least one blade element, said blade element comprising a substantially planar blade body defining an exterior exposed edge, and also defining a side edge opposing said exterior exposed edge, said blade element also comprising a securing flange attached to and extending substantially along said side edge of said blade body, said securing flange also defining a free flange edge extending along said securing flange substantially opposite said blade body, said blade element being adapted to be secured in said ferrule slot such that said blade body, including said blade edge, extends through said slot and outwardly of said peripheral surface and said securing flange and said free flange edge are disposed within said ferrule cavity; and an elongate engaging bar disposed within said ferrule cavity effective to capture said securing flange substantially along the length thereof between said engaging bar and said cavity side wall to discourage movement of said blade element relative to said ferrule slot.

2. The broadhead assembly of claim 1 further including a broadhead tip adapted to be engaged with said ferrule tip end to prevent longitudinal movement of said blade element relative to said slot.

3. The broadhead assembly of claim 2, wherein said cavity has an open end, adjacent said tip end of said ferrule, and a closed end, adjacent said shaft engaging end of said ferrule, said broadhead tip threadedly engaging said ferrule adjacent said tip end of said ferrule to close said open end of said ferrule cavity.

4. The broadhead assembly of claim 3, wherein said engaging bar is an integral engaging bar extending from said closed end of said cavity.

5. The broadhead assembly of claim 2, wherein said engaging bar is coextensive with and fixedly engaged to said broadhead tip.

6. The broadhead assembly of claim 5, wherein said ferrule defines a threaded aperture extending longitudinally of said ferrule body and opening into said closed end of said cavity and said engaging bar having a threaded free end opposite said tip, said threaded free end adapted to be received threadedly in said threaded aperture of said ferrule to cause said tip to be disposed in engagement with said tip end of said ferrule thereby closing said open end of said cavity to discourage longitudinal movement of said blade element.

7. The broadhead assembly of claim 5, wherein said cavity is a circular cavity defining a side wall radius of curvature and said engaging bar is a faceted engaging bar defining faceted engaging bar faces equal in number to the number of blade elements destined to be carried by said broadhead and, wherein said first flange side defines a first radius of curvature of said securing flange extending longitudinally along said securing flange and said second flange side defines a second radius of curvature of said securing flange extending longitudinally along said securing flange, said first radius of curvature being substantially equal to said cavity radius of curvature, so that when said facet engaging bar and said blade elements are disposed within said cavity, said first flange side of said securing flange nests in substantial engagement with said cavity side wall surface and said faceted engaging bar is disposed in line contact with said second flange side to discourage movement of said blade elements relative to said slot.

8. The broadhead assembly of claim 7, wherein said line contact between said faceted engaging bar and said second flange side is a single line contact.

9. The broadhead assembly of claim 7, wherein said line contact between said faceted engaging bar and said second flange side is a two line contact.

10. The broadhead assembly of claim 2, wherein said broadhead tip comprises a barrel portion and an opposed point portion, said point portion extending from said barrel portion and defining a point apex opposite said barrel portion.

11. The broadhead assembly of claim 10, wherein said point portion defines one or more facet faces extending from said barrel portion to said point apex.

12. The broadhead assembly of claim 11, wherein said facet face is a planar facet face.

13. The broadhead assembly of claim 11, wherein said facet face is a curved facet face defining a radius of curvature having a rotational axis perpendicular to the longitudinal axis of said ferrule.

14. The broadhead assembly of claim 11, wherein said facet face is a curved facet face defining a radius of curvature having a rotational axis parallel to the longitudinal axis of said ferrule.

15. The broadhead assembly of claim 11, wherein said facet face is a curved facet face defining radii of curvature having a first rotational axis perpendicular to the longitudinal axis of said ferrule and a second rotational axis parallel to the longitudinal axis of said ferrule.

16. The broadhead assembly of claim 1 wherein said elongate bar is capable of exerting a securing force against said securing flange and said cavity side wall to discourage movement of said blade element relative to said slot.

17. The broadhead assembly of claim 1, wherein said ferrule slot extends radially from said ferrule.

18. The broadhead assembly of claim 17, wherein said securing flange of said blade element is displaced angularly from said blade body, said securing flange defining a first flange side and an opposed second flange side, said first flange side being disposed in engagement with said cavity sidewall and said second flange side being disposed in contact with said engaging bar when said engaging bar is disposed within said cavity thereby discouraging lateral movement of said blade element.

19. The broadhead assembly of claim 18, wherein said cavity is a circular cavity defining a side wall radius of curvature and said engaging bar is a circular engaging defining an engaging bar radius of curvature and, said first flange side defines a first radius of curvature of said securing flange extending longitudinally along said securing flange and said second flange side defines a second radius of curvature of said securing flange extending longitudinally along said securing flange, said first radius of curvature being substantially equal to said cavity radius of curvature and said second radius of curvature being substantially equal to said engaging bar radius of curvature such that said securing flange nests in substantial engagement with said cavity side wall and said engaging bar when said blade element and said engaging bar are disposed in said ferrule cavity.

20. The broadhead assembly of claim 1, wherein said at least one ferrule slot comprises a plurality of ferrule slots, each ferrule slot extending from said ferrule in planes spaced radially from and parallel to the axis of said ferrule, said slots defining an included angle between adjacent pairs of slots and, further wherein said at least one blade element comprises a plurality of blade elements, said securing flange of said blade elements being angularly displaced from said blade body a prescribed angular displacement corresponding to said included angle between adjacent slots of said ferrule.

21. The broadhead assembly of claim 20, wherein said engaging bar is a circular engaging bar which engages said second flange side of said securing flange in line contact when said engaging bar and said blade elements are disposed within said cavity.

22. The broadhead assembly of claim 20, wherein said engaging bar is a faceted engaging bar having at least as many facets as said blade elements destined to be supported by said broadhead, said faceted engaging bar engaging said second flange side of said securing flanges in planar contact when said faceted engaging bar and said blade elements are disposed within said cavity.

23. The broadhead assembly of claim 1, wherein said at least one ferrule slot comprises a plurality of ferrule slots, said ferrule slots extending from said ferrule in planes spaced radially from and parallel to the axis of said ferrule, and, wherein said at least one blade element includes a plurality of blade elements, said securing flange of each blade element extending from said blade body in coplanar relation thereto, said securing flange defining a first flange side and an opposed second flange side, and including a securing groove defined in said second flange side and extending longitudinally along said securing flange at a prescribed groove depth and prescribed groove width; said first flange side being disposed in engagement with said cavity sidewall and a portion of said engaging bar being disposed within said securing groove so as to interfere with said second flange side when said engaging bar and said blade securing flanges are disposed within said cavity, thereby discouraging movement of said blade elements relative to said slots.

24. The broadhead assembly of claim 1, wherein, said blade elements are configured so that said blade elements are interchangeable with said ferrule without regard for the number of said ferrule slots defined in said ferrule.

25. An archery broadhead assembly comprising:

a ferrule, said ferrule including an elongate body having an outer peripheral surface, a shaft engaging end adapted to be engaged to an arrow shaft, and an opposed tip end adapted to receive a tip, said ferrule body defining an axially extending centrally located ferrule cavity and having an inner cavity side wall adjacent said ferrule cavity, said ferrule body further defining at least one ferrule slot extending longitudinally along said ferrule body and communicating between said outer peripheral surface and said ferrule cavity;

at least one blade element, said blade element comprising a planar blade body and a securing flange extending from said blade body continuously along a side edge of said blade body, said blade elements being adapted to be secured in said ferrule slots such that said blade body extends through said slot and outwardly of said peripheral surface and said securing flange is disposed within said ferrule cavity; and an elongate engaging bar disposed within said ferrule cavity and in contact with said securing flange and effective to capture said securing flange substantially along the length thereof between said engaging bar and said cavity side wall to discourage movement of said blade element relative to said ferrule slot.

26. An archery broadhead assembly comprising:

a ferrule, said ferrule including an elongate body having an outer peripheral surface, a shaft engaging end adapted to be engaged to an arrow shaft, and an opposed tip end adapted to receive a tip, said ferrule body defining an axially extending centrally located ferrule cavity and having an inner cavity side wall adjacent said ferrule cavity, said ferrule body further defining at least one ferrule slot extending longitudinally along said ferrule body and communicating between said outer peripheral surface and said ferrule cavity;

at least one blade element, said blade element comprising a planar blade body and a securing flange extending from said blade body continuously along a side edge of said blade body, said blade element being adapted to be secured in said ferrule slot such that said blade body extends through said slot and outwardly of said peripheral surface and said securing flange is disposed within said ferrule cavity;

an elongate engaging bar disposed within said ferrule cavity and in contact with said securing flange effective to capture said securing flange substantially along the length thereof between said engaging bar and said cavity side wall to discourage movement of said blade element relative to said ferrule slot; and a tip engagable with said tip end of said ferrule, said tip being effective to secure said blade element in engagement with said ferrule by discouraging longitudinal movement of said blade element relative to said slot.

27. The broadhead assembly of claim 26, wherein, said blade element is configured so that said blade element is interchangeable with said ferrule without regard for the number of said ferrule slots defined in said ferrule.

28. An archery broadhead assembly comprising:

a ferrule, said ferrule including an elongate body having an outer peripheral surface, a shaft engaging end and an opposed tip end, said ferrule body defining an axially extending centrally located ferrule cavity and having an inner cavity side wall adjacent said ferrule cavity, said ferrule body further defining at least one ferrule slot extending longitudinally along said ferrule body and communicating between said outer peripheral surface and said ferrule cavity;

at least one blade element, said blade element comprising a substantially planar blade body defining an exterior exposed edge, and also defining a side edge opposing said exterior exposed edge, said blade element also comprising a securing flange attached to and extending substantially along said side edge of said blade body, said securing flange also defining a free flange edge extending along said securing flange substantially opposite said blade body, said blade element being adapted to be secured in said ferrule slot such that said blade body, including said blade edge, extends through said slot and outwardly of said peripheral surface and said securing flange and said free flange edge are disposed within said ferrule cavity;

an elongate engaging bar disposed within said ferrule cavity effective to capture said securing flange substantially along the length thereof between said engaging bar and said cavity side wall to discourage movement of said blade element relative to said ferrule slot; and a broadhead tip adapted to be engaged with said ferrule tip end to prevent longitudinal movement of said blade element relative to said slot.

* * * * *

UNITED STATES PATENT AND TRADEMARK OFFICE

CERTIFICATE OF CORRECTION

PATENT NO. : 5,482,294

DATED : January 09, 1996

INVENTOR(S) : Dennis E. Sullivan

It is certified that error appears in the above-identified patent and that said Letters Patent is hereby corrected as shown below:

On the Title page; Item [57] Abstract, line 1 "for mourning to an arrow" should read --for mounting to an arrow--.

Column 9, line 63 "points are well known in the an." should read --points are well known in the art.--

Signed and Sealed this

Twenty-third Day of April, 1996

*Attest:*

Bruce Lehman

BRUCE LEHMAN

*Attesting Officer*

*Commissioner of Patents and Trademarks*